US005520032A

United States Patent [19]

Ling

[11] Patent Number: 5,520,032

[45] Date of Patent: May 28, 1996

[54] COMBINATION PADLOCK WITH READ-OUT WINDOWS

[76] Inventor: Chong-Kuan Ling, c/o Sinox Co., Ltd. P.O. Box 96-156, Taipei, Taiwan

[21] Appl. No.: 357,582

[22] Filed: Dec. 16, 1994

[51] Int. Cl.[6] ..... E05B 37/06

[52] U.S. Cl. ..... 70/25; 70/DIG. 44

[58] Field of Search ..... 70/22–29, 312, 70/315–317, DIG. 44

[56] References Cited

U.S. PATENT DOCUMENTS

| | | | |
|---|---|---|---|
| 1,486,260 | 3/1924 | Nie | 70/28 |
| 3,720,082 | 3/1973 | Feinberg | 70/25 |
| 4,048,821 | 9/1977 | Bako | 70/25 |
| 4,341,099 | 7/1982 | Garro | 70/25 |
| 4,754,623 | 7/1988 | Hwang | 70/25 |
| 4,829,794 | 5/1989 | Crown | 70/25 |
| 4,970,881 | 11/1990 | Hsiao | 70/25 |
| 5,042,277 | 8/1991 | Jenn-Roug | 70/28 |
| 5,125,248 | 6/1992 | Ling | 70/25 |

*Primary Examiner*—Steven N. Meyers
*Assistant Examiner*—Gary Estremsky

[57] ABSTRACT

A combination padlock includes a plurality of dials longitudinally rotatably mounted in a casing of the padlock, and a plurality of read-out windows juxtapositionally formed in a narrow side portion of the casing to allow each read-out window to be adapted for displaying an unique numeral of each dial and linearly aligned to be a single row to correspond a plurality of numerals of a combination for unlocking the padlock, whereby upon rotation of the dials in the casing of the padlock, the correct combination will be easily recognized and observed through the single-row read-out windows linearly formed in the side portion of the padlock for conveniently unlocking the padlock. A reset mechanism is provided for temporarily locking the shackle when unlocked for freely performing the resetting operation in a fail-safe way by the user.

1 Claim, 4 Drawing Sheets

COMBINATION PADLOCK WITH READ-OUT WINDOWS

BACKGROUND OF THE INVENTION

A conventional dial padlock, such as disclosed in the U.S. Pat. No. 3,720,082, shown in FIG. 6 includes a plurality of dials N mounted on one side of the casing C. A mark D is formed on casing C above the dials to enable opening combination numbers to align under the mark. When unlocking such a padlock, all dials N should be rotated until the correct opening combination numbers are aligned beneath the mark D.

Another conventional padlock as shown in FIG. 7, also granted to the same inventor of this application with U.S. Pat. No. 5,125,248, discloses a plurality of dials N protruding through two opposite sides of the lock through two rows of rectangular windows W formed on the front side and the rear side portion of the casing C. This padlock should also need a mark D, so that the opening combination numbers can be aligned to the mark D in order to unlock the padlock.

In both of the above padlocks, the need to locate the indicator mark D, when unlocking the padlock and to align the correct combination to the mark D, often causes inconveniences and, sometimes mistakes, for the users particularly when it is to be unlocked in a hurry.

Furthermore, in both of the above padlocks, when it is intended to reset the opening combination, the shackle S should be rotated to a correct position as shown in the dotted line of FIG. 7, and then depresses the shackle S downward F and hold it at that position while rotating the dials to set a new opening combination. However, the user often inadvertently releases the depressed shackle halfway during the resetting operation, thereby unconsciously leaving some of the dials rotated to a new combination while leaving the remaining dials unchanged at the old combination. Thus, when the dials are scrambled after the operation the user can not open the lock again neither at the old combination nor at the new combination as desired.

The present invention is directed towards improving previously existing dial padlocks by providing readout windows on the side wall of a padlock so that the user have a definite position to read out the combination number. This invention also improves the resetting mechanism so that the user needs not to hold down the shackle while performing reset operation.

SUMMARY OF THE INVENTION

The object of the present invention is to provide a combination padlock including a plurality of dials longitudinally rotatably mounted in a casing of the padlock, and a plurality of read-out windows juxtapositionally formed in a narrow side portion of the casing to allow each combination window to be adapted for displaying an unique numeral of each dial and linearly aligned to be a single row to correspond a plurality of numerals of a combination for unlocking the padlock, whereby upon rotation of the dials in the casing of the padlock, the correct combination as presented in series by the dials will be unambiguously read out and observed through the single-row combination windows linearly formed in the side portion of the padlock for conveniently unlocking the padlock.

Another object of the present invention is to provide a fail-safe resetting mechanism so that the user needs not to hold down the shackle while performing a reset operation for changing a combination number of the lock.

DETAILED DESCRIPTION

Figure 1:
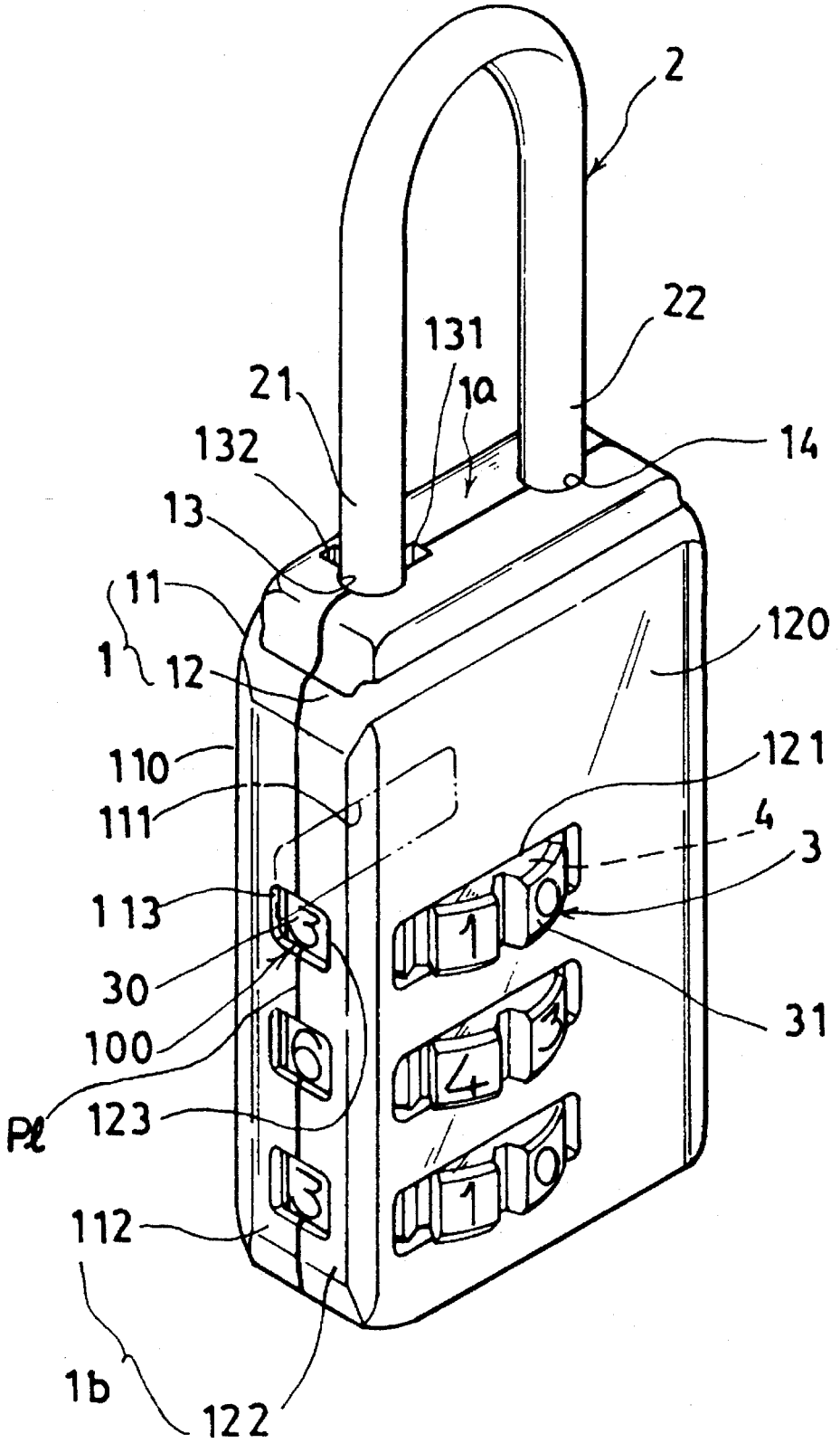
FIG. 1 is a perspective view of the present invention.

As shown in FIGS. 1–5, the present invention comprises: a casing 1, a shackle 2 generally U shaped, a plurality of dials 3, a plurality of sleeves 4, and a locking bolt means 5.

The casing 1 includes: two half-shell portions 11, 12 integrally combined to form the casing 1, each half-shell portion 11 or 12 having a wide-surface side portion 110 or 120 to be disposed on either a front side or a rear side of the casing 1 and having a plurality of elongated slots 111, 121 transversely formed in the two wide-surface side portions 110, 120 to outwardly protrude a periphery portion of each dial 3, and a plurality of read-out windows 100 juxtapositionally formed in a narrow-surface side portion 1*b* comprised of a pair of side edge portions 112, 122 of the two wide-surface side portions 110, 120 to allow each read-out window 100 to be adapted for matchably displaying an unique numeral of each dial 3 and with the read-out windows 100 linearly aligned to be a single row to correspond a plurality of numerals of a combination for unlocking the padlock.

Each read-out window 100 is comprised of a pair of semi-rectangular notches 113,123 each notch 113,123 recessed in each side edge portion 112, 122 of the narrow-surface side portion 1*b* of the casing 1, and with the two side edge portions 112, 122 and each pair of the semi-rectangular notches 113, 123 being separated from each other by a parting line P1.

The shackle 2 generally U shaped includes a long leg member 21 pivotally mounted in a shackle hole 13 formed in a pivotal side P of an upper portion 1*a* of the casing 1, a shackle head portion 23 formed on a lowest end portion of the long leg member 21 and rotatably engageable with the locking bolt means 5, a short leg member 22 lockably engageable with a shackle socket 14 recessed in a locking side L of the upper portion 1*a* of the casing 1, and a shackle projection 211 longitudinally formed on the long leg member 21 and engageable with a first projection socket 131 which is recessed in the upper portion 1*a* of the casing 1 to be generally aligned with the shackle socket 14 and communicated with the shackle hole 13 when the short leg member 22 is locked in the shackle socket 14, and with the shackle projection 211 rotatably engageable with a second projection socket 132 which is recessed in the upper portion 1*a* of the casing 1 and deviated from the first projection socket 131 with a right angle.

Each dial 3 is rotatably mounted in the casing 1 along a pivotal axis A parallel with and eccentric to a longitudinal center A1 of the casing 1, and includes: an outer ring 31 having a plurality of numerals 30 such as: 0, 1, 2, . . . , 9 annularly formed on the outer ring 31, an inner ring 33 circumferentially formed in an inside surface of the outer ring 31 having a plurality of ring teeth 32 annularly formed in the inner ring 33 to be engageable with each sleeve 4.

Each sleeve 4 includes: a central bolt hole 40 formed through the sleeve 4 for engaging the locking bolt means 5, an opening slot 41 longitudinally slotted in the sleeve 4 and communicated with the central bolt hole 40, a plurality of coupling teeth 42 circumferentially formed on a cylindrical surface of the sleeve 4 to be engageable with the ring teeth 32 formed in each dial 3, an annular shoulder portion 43 concentrically recessed in a lower portion of the sleeve 4 and radially enlarged from the central bolt hole 40, with an uppermost sleeve 4 rotatably held in a sleeve bush 5 formed in the casing 1 for limiting the sleeves 4 from an upper portion of the casing 1 and with a lowest sleeve 4 resiliently retained on a retaining washer 45 having a central washer hole 451 formed therethrough and a sleeve tension spring 44 held in a bottom spring socket 18 formed in a lower portion of the casing 1 for normally urging the washer 45 and the sleeves 4 upwardly to be limited by the sleeve bush 15 for ensuring a smooth engagement between each sleeve 4 and each dial 3.

Figure 3:
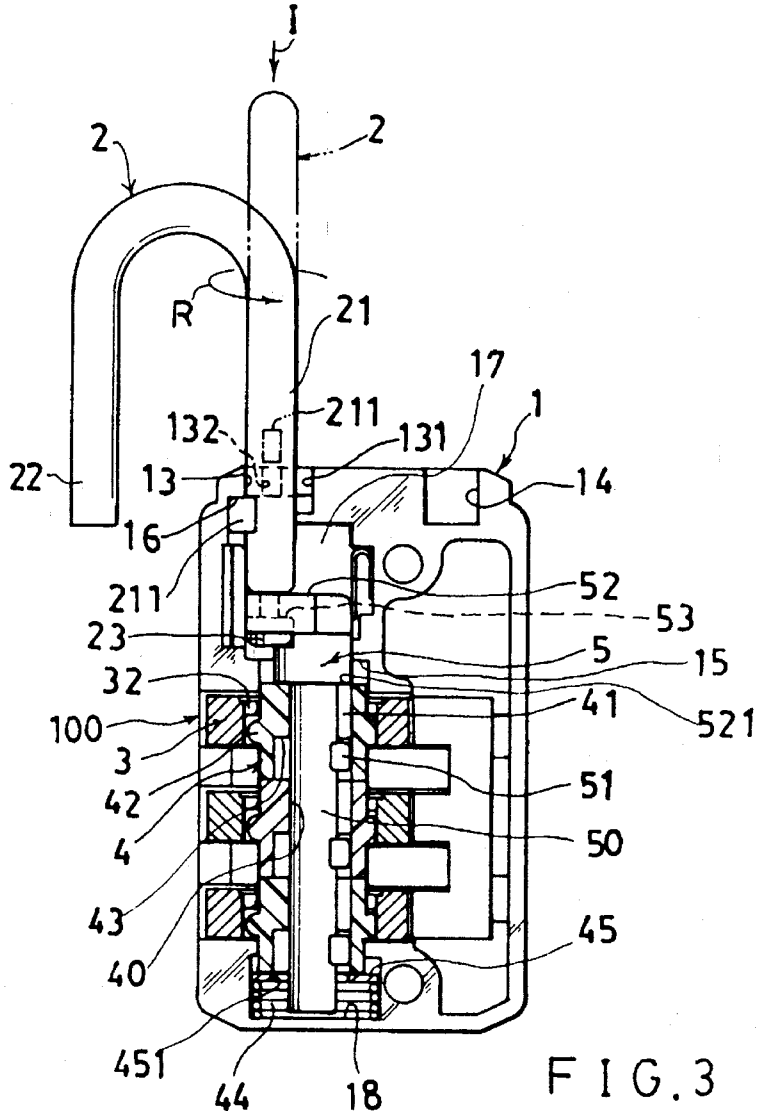
FIG. 3 is a sectional drawing of the present invention when resetting a new combination.
Figure 4:
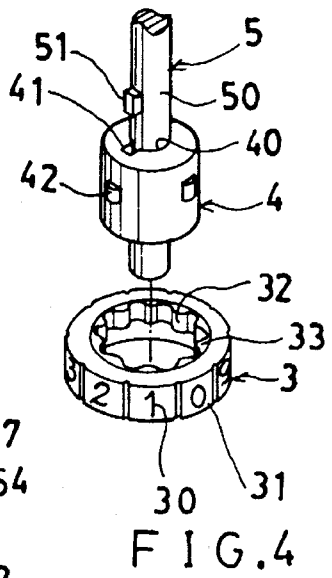
FIG. 4 is a partial perspective view of a locking bolt means and a dial of the present invention.
Figure 2:
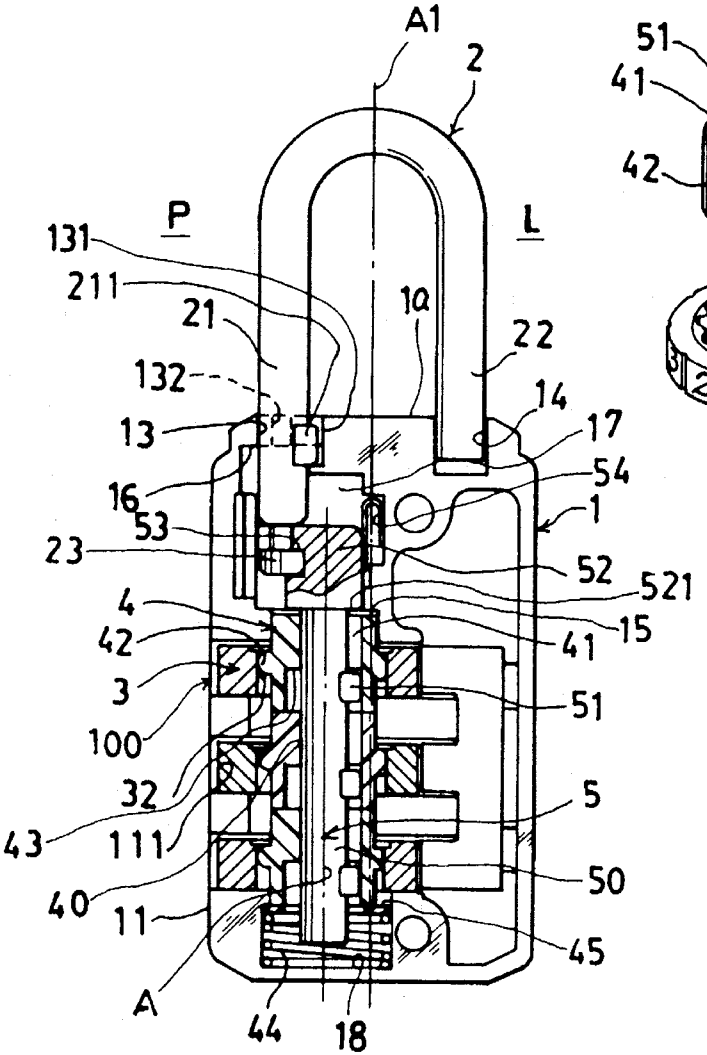
FIG. 2 is a sectional drawing of the present invention when rotating the dials to be an unlocking situation.

The locking bolt means 5 includes: a locking bolt 50 rotatably engageable with the central bolt hole 40 of each sleeve 4, a plurality of bolt projections 51 longitudinally formed on the locking bolt 50, each bolt projection 51 normally retained under the annular shoulder portion 43 of each sleeve 4 when the padlock is locked and operatively passing through each opening slot 41 formed in each sleeve 4 when the padlock is unlocked, a bolt head portion 52 formed on an upper portion of the locking bolt 50 and held in a bolt-head chamber 17 formed in an upper portion in the casing 1 as resiliently retained by a spring plate 54, a coupling recess 53 formed in the bolt head portion 52 for rotatably engaging the shackle head portion 23 of the shackle 2, and a bottom portion 521 of the bolt head portion 52 normally contacting an uppermost sleeve 4 ready for a downward depression (I) on the sleeves 4 when opening the padlock for changing a new combination as shown in FIG. 3.

When using the present invention for locking purpose, the dials 3 and the sleeves 4 can be rotated to diviate the opening slots 41 of the sleeves 4 from the bolt projections 51 of the locking bolt means 5, whereby upon upwardly pulling of the shackle 2 trying to unlock the padlock, the locking bolt means 5 as coupled with the shackle 2 will also be pulled upwardly and the bolt projections 51 on the locking bolt 50 will be obstructed by the annular shoulder portions 43 of the sleeves 4, thereby preventing the upwardly pulling of the bolt 50 and the shackle 2 and locking the shackle 2 in the casing 1.

For opening the padlock of the present invention, the dials 3 and the sleeves 4 are rotated to match the bolt projections 51 on the locking bolt 50 with the opening slots 41 in the sleeves 4 to allow a free upwardly pulling of the bolt 50 and the shackle 2 for opening the padlock.

Figure 5:
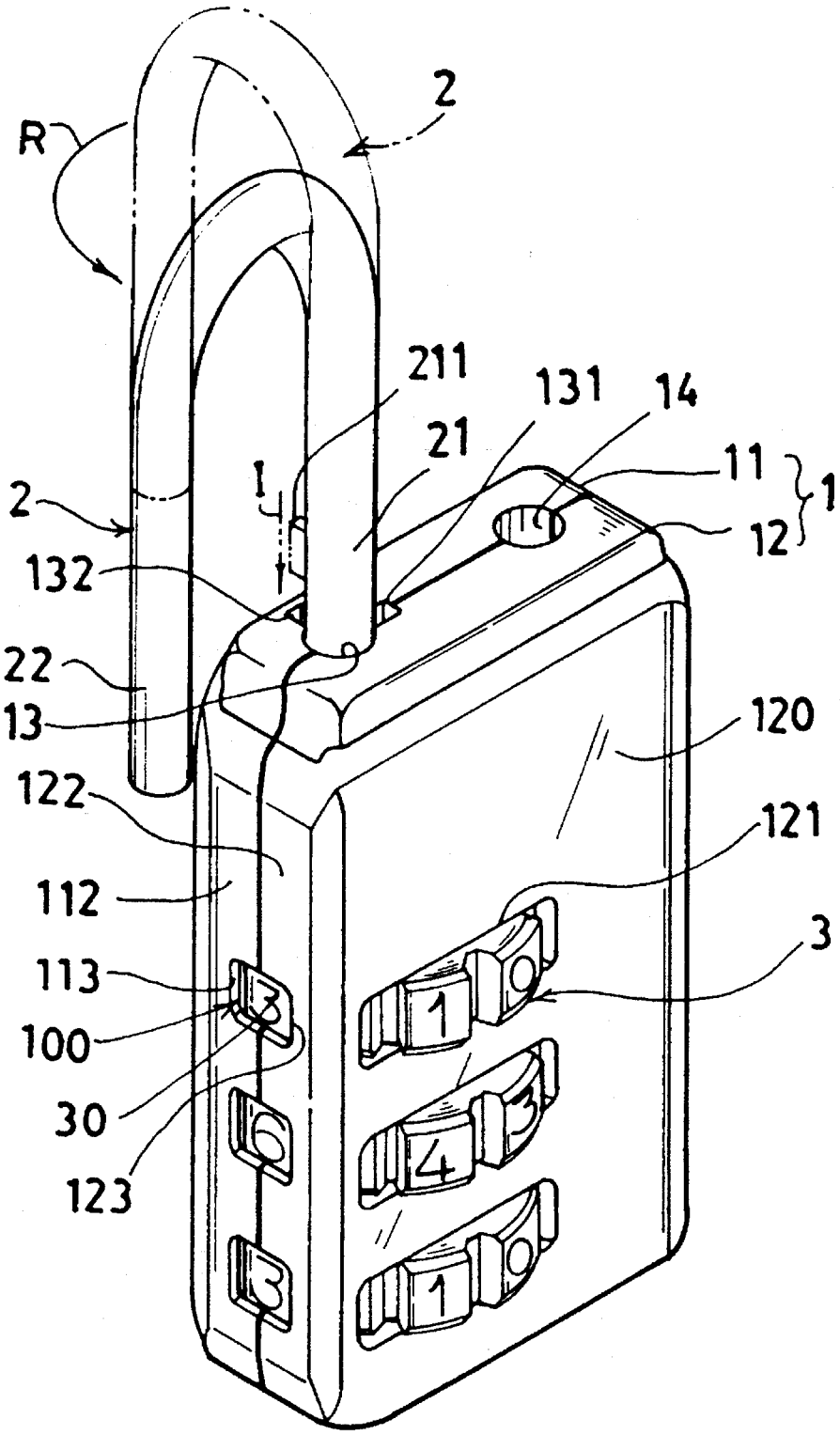
FIG. 5 is a perspective view of the present invention as shown in FIG. 3.
Figure 6:
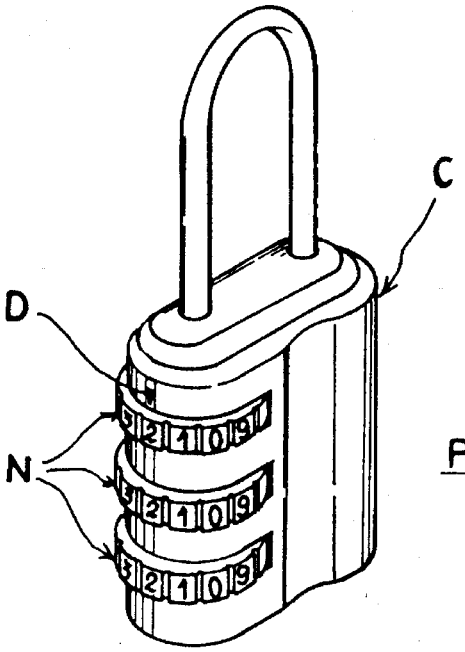
FIG. 6 shows a first conventional combination padlock.
Figure 7:
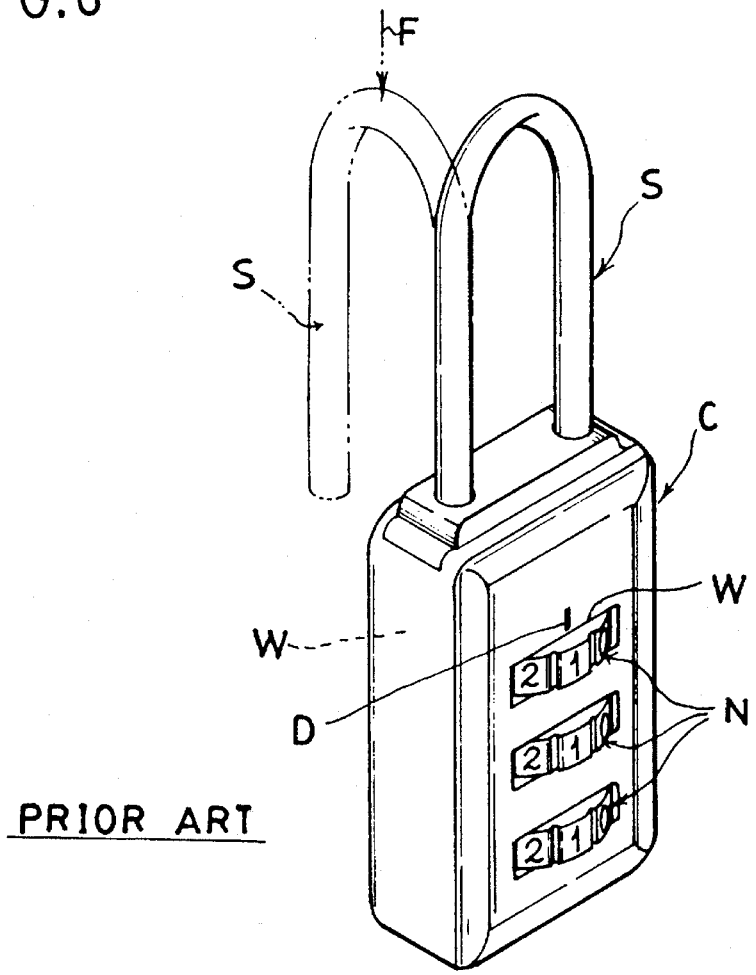
FIG. 7 shows a second conventional combination padlock.

When the padlock is unlocked, the shackle 2 is pulled upwardly and rotated by pivoting the long leg member 21 about the shackle hole 13 to also rotate the shackle projection 211 in a right angle from the first projection socket 131 towards the second projection socket 132 as shown in dotted line of FIGS. 5, 3. The shackle 2 is then depressed downwardly (I) to insert the shackle projection 211 through the second projection socket 132 into the bolt-head chamber 17 in the casing 1 and then the shackle 2 is re-rotated (R) for a further right angle to engage the shackle projection 211 with a retarding chamber 16 recessed in an upper side portion of the casing 1, with the retarding chamber 16 generally positioned to be lower than the first and second projection sockets 131,132 formed in the upper portion 1*a* of the casing 1 and with the retarding chamber 16 being diametrically separated from the first projection socket 131 for 180 degrees. Therefore, the shackle projection 211 is stably locked with the retarding chamber 16 in the casing 1 and the depression of the shackle 2 will allow the bottom portion 521 of the bolt head portion 52 to pressurize the sleeves 4 downwardly to disengage the coupling teeth 42 on the sleeves 4 from the teeth 32 of the dials 3, thereby allowing a free rotation of the dials 3 for resetting a new combination for the padlock of the present invention. The shackle 2 is then rotated backwardly to projectively align the projection 211 with the second socket 132 and the spring 44 will urge the sleeves 4 and the shackle 2 upwardly to outwardly move the projection 211 beyond the upper surface of the casing 1, whereby the shackle 2 is then rotated to re-insert the short leg member 22 to be locked into the shackle socket 14 and to hold the shackle projection 211 into the first projection socket 131 for locking the padlock.

The present invention is superior to the conventional combination padlock with the following advantages:

1. Only a single-row arrangement of read-out windows 100 is provided in the casing 1 of the padlock for saving the "procedure" for searching the locations of the opening combination for instantly displaying the unlocking combination for a quickest and most convenient unlocking operation for the combination padlock.
2. The padlock can be operated in an easier way for saving force for resetting a new combination of the padlock by rotating the shackle 2 for 180 degrees from its original locking position and locking the shackle projection 211 in a retarding chamber 16 in the casing 1 without continuously holding down the shackle 2 during the combination resetting operation. Meanwhile, the resetting operation can be reliably performed without scrambling the dial numbers since the shackle is temporarily locked in the retarding chamber 16 during the resetting operation, thereby providing a fail-safe resetting mechanism.

The present invention may be modified without departing from the spirit and scope of this invention. The locations of the read-out windows 100 in the casing 1 and the shapes of the casing may be optionally chosen, not limited in this invention.

I claim:

1. A combination padlock comprising:

a casing;

a plurality of dials and sleeves, each said dial engageable with each said sleeve, rotatably mounted in said casing;

a shackle normally locked in said casing and rotatably coupled with a locking bolt means rotatably held in said casing and engageable with each said sleeve; said shackle generally U shaped including a long leg member pivotally mounted in a shackle hole formed in a pivotal side of an upper portion of the casing, a shackle head portion formed on a lowest end portion of the long leg member and rotatably engageable with the locking bolt means, a short leg member lockably engageable with a shackle socket recessed in a locking side of the upper portion of the casing, and a shackle projection longitudinally formed on the long leg member and engageable with a first projection socket which is recessed in the upper portion of the casing to be generally aligned with the shackle socket and communicated with the shackle hole when the short leg member is locked in the shackle socket, and with the shackle projection rotatably engageable with a second projection socket which is recessed in the upper portion of the casing and deviated from the first projection socket with a right angle; and said casing having a plurality of read-out windows juxtapositionally formed in a side portion of said casing, and each said read-out window matchable with an unique numeral of a plurality of numerals circumferentially formed on each said dial, whereby upon rotation of said dials, a combination number presented in series by said dials will be unambiguously read out through said windows;

the improvement which comprises:

said casing including: a retarding chamber recessed in an upper side portion of the casing, with the retarding chamber generally positioned to be lower than the first and second projection sockets formed in the upper portion of the casing and with the retarding chamber being diametrically separated from the first projection socket for 180 degrees about said long leg member of said shackle, the shackle projection operatively locked with the retarding chamber in the casing, whereby upon depression of the shackle to allow a bottom portion of a bolt head portion of a locking bolt means to pressurize a plurality of sleeves downwardly to disengage the sleeves from a plurality of dials for a free rotation of said dials for resetting a new combination.

* * * * *